US008420173B2

(12) United States Patent
Kida et al.

(10) Patent No.: US 8,420,173 B2
(45) Date of Patent: Apr. 16, 2013

(54) PRODUCTION METHOD OF PRODUCING WRAPPER FOR CIGARETTES

(75) Inventors: Shinzo Kida, Tokyo (JP); Yuzuru Sakuma, Tokyo (JP); Takafumi Izumiya, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 57 days.

(21) Appl. No.: 12/851,871

(22) Filed: Aug. 6, 2010

(65) Prior Publication Data

US 2010/0297351 A1 Nov. 25, 2010

Related U.S. Application Data

(63) Continuation of application No. PCT/JP2009/051612, filed on Jan. 30, 2009.

(30) Foreign Application Priority Data

Feb. 8, 2008 (JP) ..... 2008-028870

(51) Int. Cl.
*B05D 3/00* (2006.01)

(52) U.S. Cl.
USPC ..... 427/299; 427/384

(58) Field of Classification Search ..... 427/299, 427/384
See application file for complete search history.

(56) References Cited

U.S. PATENT DOCUMENTS

| | | | | |
|---|---|---|---|---|
| 5,820,998 | A * | 10/1998 | Hotaling et al. | 428/533 |
| 6,645,605 | B2 * | 11/2003 | Hammersmith et al. | 428/198 |
| 2002/0139381 | A1 * | 10/2002 | Peterson et al. | 131/365 |
| 2009/0025742 | A1 | 1/2009 | Matsufuji et al. | |

FOREIGN PATENT DOCUMENTS

| | | | |
|---|---|---|---|
| JP | 7-300795 | A | 11/1995 |
| JP | 07-316996 | A | 12/1995 |
| JP | 2004-115975 | A | 4/2004 |
| JP | 2004-512849 | A | 4/2004 |
| JP | 2005-514939 | A | 5/2005 |
| WO | WO 02/37991 | A1 | 5/2002 |
| WO | WO 03/061410 | A1 | 7/2003 |
| WO | WO 2007/119484 | A1 | 10/2007 |

* cited by examiner

*Primary Examiner* — Timothy Meeks
*Assistant Examiner* — Nathan T Leong
(74) *Attorney, Agent, or Firm* — Birch, Stewart, Kolasch & Birch, LLP

(57) ABSTRACT

A production method for producing a wrapper for cigarettes is provided wherein, with a web kept traveling, a combustion inhibitor in liquid form is intermittently applied to one surface of the web to form undried banded layers arranged with a predetermined space therebetween in the traveling direction of the web, water is applied to the surface of the web over its entire area before or after the combustion inhibitor is applied, and then the web is rapidly dried.

9 Claims, 3 Drawing Sheets

PRODUCTION METHOD OF PRODUCING WRAPPER FOR CIGARETTES

CROSS REFERENCE TO RELATED APPLICATIONS

This application is a Continuation of PCT International Application No. PCT/JP2009/051612 filed on Jan. 30, 2009, which claims the benefit of Patent Application No. 2008-28870 filed in Japan on Feb. 8, 2008. The entire contents of all of the above applications is hereby incorporated by reference into the present application.

TECHNICAL FIELD

The present invention relates to a production method for producing a wrapper for cigarettes.

BACKGROUND ART

In recent years, cigarettes with low ignition propensity have been developed. Such cigarettes can, even if lit and placed on a flammable object, reduce the possibility of the flammable object catching fire (e.g., Patent Document 1).

The cigarette disclosed in Patent Document 1 includes a wrapper of paper, and the wrapper has a plurality of banded layers containing a combustion inhibitor. The banded layers individually encircle the whole circumference of the cigarette and are arranged with a predetermined space therebetween in the axial direction of the cigarette.

More specifically, the wrapper is produced by a method in which, with a web for forming the wrapper kept traveling, the combustion inhibitor in liquid form is intermittently applied to the web to form the banded layers on the web, and then the banded layers are dried together with the web.

In the production method disclosed in Patent Document 1, the banded layers are formed in the following manner: The process of applying the combustion inhibitor to the web is performed a plurality of times, and immediately after each application process is executed, the process of drying the web is performed.

Thus, in the production method of Patent Document 1,the process of applying the combustion inhibitor and the drying process are each carried out a plurality of times, and therefore, the amount of the combustion inhibitor necessary for each application process is small. Accordingly, even if the treated regions of the web applied with the combustion inhibitor shrink during the drying process executed subsequently to each application process, wrinkles formed in the other untreated regions of the web can presumably be minimized, thus maintaining the quality of the web, namely, the quality of the wrapper.

Prior Art Document

Patent Document 1: PCT-based Japanese Laid-open Patent Publication No. 2004-512849

DISCLOSURE OF THE INVENTION

Problems to be Solved by the Invention

In the case of the production method disclosed in Patent Document 1, however, an applicator device for applying the combustion inhibitor is required for each application process and also a drying device for performing the drying process needs to be associated with each application process. Consequently, not only the production equipment for carrying out the production method of Patent Document 1 is costly but also the maintenance and inspection of the production equipment cost a great deal, making it impossible to provide inexpensive wrapping paper for low-ignition-propensity cigarettes.

An object of the present invention is to provide a production method capable of stably producing a high-quality wrapper for cigarettes at low cost.

Means for Solving the Problems

To achieve the above object, a production method according to the present invention comprises steps of: causing a web for forming a wrapper for cigarettes to travel; applying a combustion inhibitor in liquid form to one surface of the traveling web to form banded layers of the combustion inhibitor, the banded layers each extending in a width direction of the web over an entire width of same and arranged with a predetermined space therebetween in a traveling direction of the web; applying water to the traveling web before or after the combustion inhibitor is applied; and drying the web applied with the combustion inhibitor and the water.

According to the production method, the web is applied with water before being dried. Thus, when the web is dried thereafter, shrinkage occurs uniformly over the entire area of the web, so that a wrinkleless web is obtained, that is, a wrinkleless wrapper for cigarettes having the banded layers is produced.

Specifically, the step of applying water is executed before the combustion inhibitor is applied, and the water is applied to the one surface of the web over an entire area of same.

In this case, the liquid combustion inhibitor preferably has higher viscosity than water. Specifically, the liquid combustion inhibitor is an aqueous solution of sodium alginate.

Alternatively, the step of applying water may be executed after the combustion inhibitor is applied. In this case, the water is applied to the other surface of the web over an entire area of same.

Further, the water may be applied only to regions of the one surface of the web other than regions where the combustion inhibitor is applied. In this case, the liquid combustion inhibitor is applied to the web by using a screen roller, and the water is applied to the web by using a gravure roller.

Advantageous Effects of the Invention

In the wrapper production method of the present invention, water is applied to the web before the web is subjected to the drying step. Accordingly, although the combustion inhibitor in liquid form is applied to the web, it is possible to produce a wrapper having the banded layers of the combustion inhibitor and free of wrinkles despite the web drying step.

Also, the step of applying the combustion inhibitor to the web and the drying step each need to be executed only once, whereby production equipment for carrying out the production method can be significantly simplified, making it possible to provide an inexpensive wrapper.

MODE FOR CARRYING OUT THE INVENTION

Figure 1:
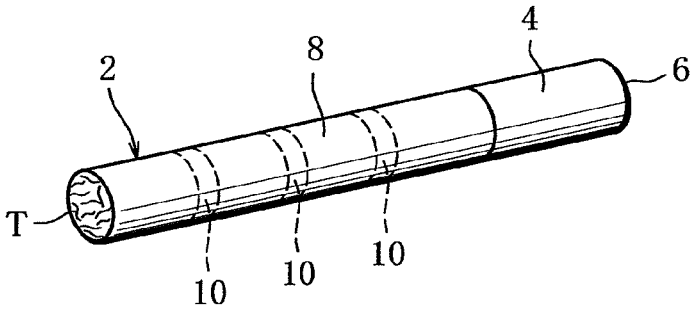
FIG. 1 is a schematic perspective view of a low-ignition-propensity cigarette.

FIG. 1 illustrates a filter cigarette with low ignition propensity. The filter cigarette includes a cigarette 2 and a filter 6 arranged adjacent to one end of the cigarette 2. The filter 6 and the cigarette 2 are connected to each other by tip paper 4 wound thereon. The cigarette 2 has shredded tobacco T and a wrapper 8 wrapping the shredded tobacco T therein in the form of a rod. The wrapper 8 has a plurality of banded layers 10 formed thereon, and the banded layers 10 impart low ignition propensity to the cigarette 2. More specifically, the banded layers 10 have a fixed width H, extend over a whole circumference of the cigarette 2, and are arranged with a predetermined pitch P in the axial direction of the cigarette 2. For example, the width H and pitch P of the banded layers 10 are 7 mm and 27 mm, respectively.

Figure 2:
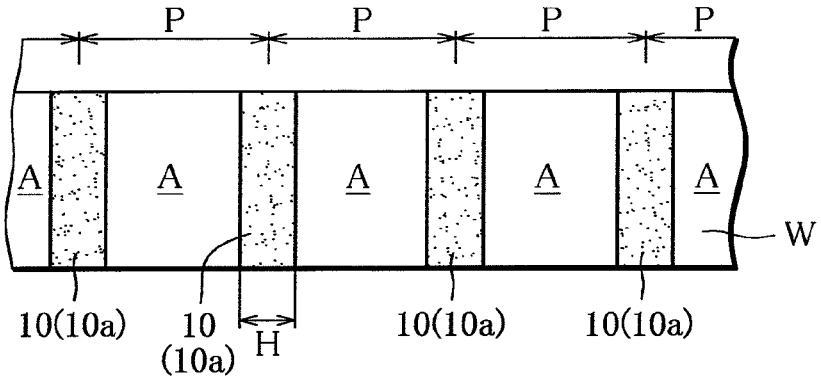
FIG. 2 illustrates part of a web for forming a wrapper.

The wrapper 8 is obtained by cutting a web W, shown in FIG. 2, into a predetermined length, and the web W has the banded layers 10 formed thereon with a pattern coinciding with the aforementioned width H and pitch P. The banded layers 10 are formed by applying a combustion inhibitor in liquid form, or more specifically, an aqueous solution of sodium alginate, to the web W and then drying the web W. The aqueous solution contains 2 to 4 weight % of sodium alginate.

The web W having the banded layers 10 formed thereon is supplied to a cigarette manufacturing machine, where the cigarettes 2 with the banded layers 10 are manufactured by using the web B.

Figure 3:
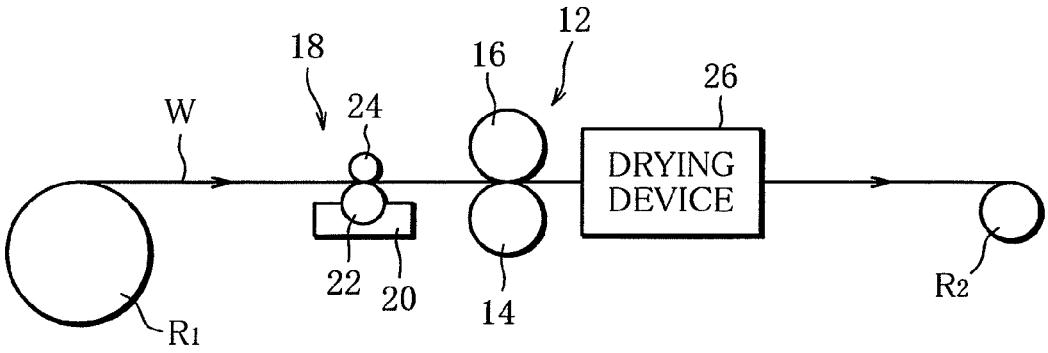
FIG. 3 schematically illustrates production equipment for carrying out a production method according to a first embodiment.

FIG. 3 schematically illustrates production equipment for producing the web W. This production equipment carries out a production method according to a first embodiment.

The production equipment has a feed reel $R_1$ for feeding the web W. The feed reel $R_1$ feeds the web W along a feed path toward a take-up reel $R_2$, and the web W thus fed is then wound up around the take-up reel $R_2$.

An applicator device 12 is arranged across the feed path and includes a gravure roller 14 and a pinch roller 16. The feed path passes between the gravure roller 14 and the pinch roller 16, and therefore, the gravure roller 14 and the pinch roller 16 can nip the web W therebetween. The web W fed from the reel $R_1$ travels toward the reel $R_2$ along the feed path, and when the web W passes through the applicator device 12, the gravure roller 14 intermittently applies the aqueous solution of sodium alginate to one surface, that is, an underside surface, of the web W to form banded layers 10*a* with the aforementioned pattern. The banded layers 10*a* are not dried yet and thus are wet.

In this embodiment, an additional applicator device 18 for applying water is arranged across the feed path at a location upstream of the applicator device 12. The applicator device 18 includes a water tank 20, an applicator roller 22 partly immersed in water in the water tank 20, and a pinch roller 24 arranged immediately above the applicator roller 22, and the web W passes between the applicator roller 22 and the pinch roller 24. When the web W passes through the applicator device 18, the applicator roller 22 applies the water to the underside surface of the web W over its entire area.

Further, a drying device 26 is arranged across the feed path at a location downstream of the applicator device 12. The feed path passes through the drying device 26. When the web W passes through the drying device 26, the drying device 26 rapidly dries the web W, together with the banded layers 10*a*, to form the banded layers 10, the web W with the banded layers 10 being delivered to the take-up reel $R_2$.

According to the production method of the first embodiment using the aforementioned production equipment, during the process of travel of the web W from the feed reel $R_1$ to the take-up reel $R_2$, water is first applied to the entire underside surface of the web W by the applicator device 18. Subsequently, the aqueous solution of sodium alginate for forming the banded layers 10*a* is applied to the underside surface of the web W by the applicator device 12. The aqueous solution is higher in viscosity than water. Accordingly, the aqueous solution applied to the web W pushes aside the water already applied to the web W and accurately forms the banded layers 10*a* having the aforementioned pattern.

The web W then enters the drying device 26, where the web W is heated to a drying temperature of, for example, 100° C. to 200° C., preferably, 170° C., to be rapidly dried at the drying temperature. Since water has been applied to the underside surface of the web W over its entire area, the web W shrinks uniformly as a whole when rapidly dried. Therefore, no wrinkles are formed in the regions other than the banded layers 10*a*, that is, the regions not applied with the aqueous solution of sodium alginate. As a result, the web W, namely, the wrapper 8, which has the banded layers 10 but is free of wrinkles is produced.

Also, according to the production method of the first embodiment, the application step for forming the banded layers 10*a* and the step of drying the web W individually need to be executed only once. Thus, the production equipment neither enlarges in scale nor becomes complex, making it possible to provide the wrapper 8 at low cost.

In the case of the first embodiment, the banded layers 10 may alternatively be formed on the upper surface of the web W.

Figure 4:
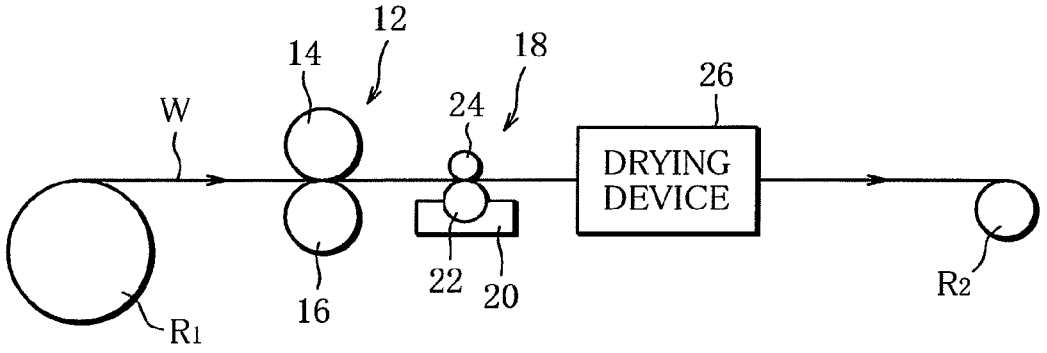
FIG. 4 schematically illustrates production equipment for carrying out a production method according to a second embodiment.

FIG. 4 schematically illustrates production equipment for carrying out a production method according to a second embodiment.

The production equipment illustrated in FIG. 4 differs from that illustrated in FIG. 3 only in the following respect: Specifically, in the production equipment shown in FIG. 4, the applicator device 12 for applying the aqueous solution of sodium alginate is arranged upstream of the applicator device 18 for applying water.

Thus, according to the production method of the second embodiment using the production equipment illustrated in FIG. 4, first, the banded layers 10*a* are formed on the upper surface of the web W, then water is applied to the underside surface of the web W over its entire area, and the web W is dried. Also in this case, the web W having the banded layers 10 but free of wrinkles can be produced in like manner.

Figure 5:
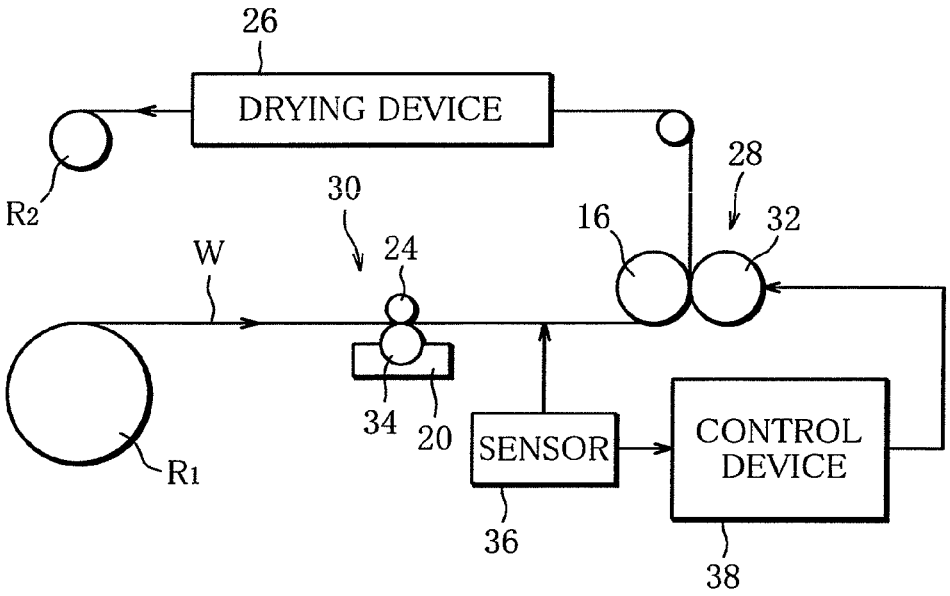
FIG. 5 schematically illustrates production equipment for carrying out a production method according to a third embodiment.

FIG. 5 schematically illustrates production equipment for carrying out a production method according to a third embodiment.

The production equipment illustrated in FIG. 5 is equipped with applicator devices 28 and 30, in place of the applicator devices 12 and 18, respectively, illustrated in FIG. 3. The applicator device 28 uses a screen roller 32, instead of the gravure roller 14 of the applicator device 12, and the screen roller 32 forms the banded layers 10*a* on the underside or reverse surface of the web W, like the gravure roller 14.

On the other hand, the applicator device 30 uses a gravure roller 34, instead of the applicator roller 22 of the applicator device 18, and the gravure roller 34 applies water to part of the underside or reverse surface of the web W. More specifically, the gravure roller 34 applies the water only to bandless regions of the web W other than band-forming regions where the banded layers 10*a* are formed by the downstream-side applicator device 28.

The production equipment of FIG. 5 further comprises a sensor 36 arranged between the applicator devices 28 and 30. The sensor 36 detects the water applied to the web W, namely, the bandless regions (indicated by the reference sign A in FIG. 2) of the web W, and supplies a detection signal to a control device 38. In accordance with the detection signal from the sensor 36, the control device 38 controls the rotation of the screen roller 32, so that the screen roller 32 can accurately form the banded layers 10*a* between the bandless regions of the web W, that is, on the band-forming regions.

According to the production method of the third embodiment using the production equipment illustrated in FIG. 5, first, water is applied only to the bandless regions, out of the underside reverse surface of the web W, and then the banded layers 10*a* is formed on the regions between the bandless regions. Subsequently, the web W is supplied to the drying device 26 to be dried thereby, whereby the web W having the banded layers 10 but free of wrinkles is produced.

In the case of the production method of the third embodiment, the respective positions of the applicator devices 28 and 30 may be reversed.

Further, the present invention is not limited to the foregoing embodiments alone.

For example, the production methods of the present invention may carried out in the process wherein the web W is supplied from the feed reel $R_1$ to the cigarette manufacturing machine, to apply water to and form the banded layers 10*a* on the web W. Also, instead of the aqueous solution of sodium alginate, some other suitable combustion inhibitor in liquid form may be used to form the banded layers.

EXPLANATION OF REFERENCE SIGNS

2 cigarette
4 tip paper
6 filter
8 wrapper
10 banded layer
10*a* banded layer before drying
12, 28 combustion inhibitor applicator device
18, 30 water applicator device
26 drying device
36 sensor
38 control device
$R_1$ feed reel
$R_2$ take-up reel
W web

The invention claimed is:

1. A production method for producing a wrapper for cigarettes, comprising steps of:

causing a web for forming the wrapper for cigarettes to travel;

applying a combustion inhibitor in liquid form to one surface of the traveling web to form banded layers of the combustion inhibitor, the banded layers each extending in a width direction of the web over an entire width of the web and arranged with a predetermined space therebetween in a traveling direction of the web;

applying water to the traveling web using a gravure roller before the combustion inhibitor is applied; and drying the web applied with the combustion inhibitor and the water, wherein the combustion inhibitor in liquid form has higher viscosity than the water.

2. The production method according to claim 1, wherein the water is applied to the one surface of the web over an entire area the web.

3. The production method according to claim 1, wherein the combustion inhibitor in liquid form is an aqueous solution of sodium alginate.

4. The production method according to claim 3, wherein the aqueous solution contains 2 to 4 weight % of sodium alginate.

5. The production method according to claim 1, wherein the water is applied only to regions of the one surface of the web other than regions where the combustion inhibitor is applied.

6. The production method according to claim 5, wherein:

the combustion inhibitor in liquid form is applied to the web by using a screen roller.

7. The production method according to claim 6, wherein rotation of the screen roller is controlled in accordance with position of the water applied to the web.

8. The production method according to claim 1, wherein:

the combustion inhibitor in liquid form is applied to the web by using one of the gravure roller and a screen roller.

9. The production method according to claim 1, wherein the water is applied to the one surface of the web over an entire area the web, and wherein the combustion inhibitor in liquid form is an aqueous solution of sodium alginate.

* * * * *